US006089373A

United States Patent [19]

Cope

[11] Patent Number: 6,089,373

[45] Date of Patent: Jul. 18, 2000

[54] CONTAINERS

[75] Inventor: Andrew Christopher Cope, West Midlands, United Kingdom

[73] Assignee: McKechnie UK Limited, West Midlands, United Kingdom

[21] Appl. No.: 09/214,210

[22] PCT Filed: Jul. 3, 1997

[86] PCT No.: PCT/GB97/01795

§ 371 Date: Mar. 15, 1999

§ 102(e) Date: Mar. 15, 1999

[87] PCT Pub. No.: WO98/01352

PCT Pub. Date: Jan. 15, 1998

[30] Foreign Application Priority Data

| | | | |
|---|---|---|---|
| Jul. 3, 1996 | [GB] | United Kingdom | 9613949 |
| Aug. 16, 1996 | [GB] | United Kingdom | 9617218 |

[51] Int. Cl.[7] ..... B65D 21/00

[52] U.S. Cl. ..... 206/505; 206/558; 220/23.4

[58] Field of Search ..... 206/505, 558; 220/23.4, 23.6

[56] References Cited

U.S. PATENT DOCUMENTS

| | | | |
|---|---|---|---|
| 3,651,976 | 3/1972 | Chadbourne | 206/558 X |
| 5,263,576 | 11/1993 | Boreen et al. | 220/23.4 X |
| 5,344,022 | 9/1994 | Stahl | 206/505 X |

FOREIGN PATENT DOCUMENTS

| | | |
|---|---|---|
| 0 208 020 | 1/1987 | European Pat. Off. . |
| 1 437 596 | 3/1966 | France . |
| 19 54 298 | 5/1971 | Germany . |
| 44 28 495 A1 | 2/1996 | Germany . |
| 517 623 | 2/1972 | Switzerland . |
| 536 232 | 6/1973 | Switzerland . |
| 668 404 | 12/1988 | Switzerland . |

*Primary Examiner*—Steven Pollard

*Attorney, Agent, or Firm*—Adams, Schwartz & Evans, P.A.

[57] ABSTRACT

An open-topped container (which may be lidded) is generally rectangular, having long sides (12) and short sides (14). The outer surfaces of the walls (12, 14) are provided with formations, at locations (20), which may engage formations on an adjacent like container to limit relative vertical movement of the containers and thus improve stability of stacks, when stacks are placed alongside each other.

7 Claims, 5 Drawing Sheets

CONTAINERS

This application is a national stage application, according to Chapter II of the Patent Cooperation Treaty. This application claims the priority date of Jul. 3, 1996 for Great Britain Patent Application No. 9613949.8.

The present invention relates to containers and particularly, but not exclusively, to containers which can be formed into piles by stacking or nesting.

Stacking and/or nesting containers are commonly used for delivering goods to retail premises. They may be stacked onto pallets to which they are attached by securing bands, for ease of handling e.g. by fork truck. Adequacy of securing these pallet loads is important to ensure that container contents are not damaged, and that pallets can be safely handled.

The present invention seeks to facilitate the provision of secure stacks in these situations.

According to the invention, there is provided a container of generally rectangular shape in plan, the container having upstanding walls around its periphery and there being formations on the outer surfaces of the walls for engagement with formations on an adjacent like container to limit relative vertical movement of the containers, the formations being so arranged to provide for engagement as aforesaid when adjacent containers are arranged long side to long side, short side to short side, or long side to short side.

The formations preferably include first formations and further include second formations which are complementary in form to first formations, whereby a first formation may engage a second formation on an adjacent container to limit relative vertical movement is aforesaid.

First formations may comprise a projection or recess at a first height on the container, and second formations may comprise a recess or projection, respectively, at the said first height, whereby the projection or recess of a first formation may mate with the recess or projection of a second formation on an adjacent container. The first formations may be located at diagonally opposite positions along opposed walls of the container, second formations being located at positions opposite the first formations, whereby first and second formations will meet when one of the said opposed walls is brought adjacent to one of the corresponding opposed walls of a like container.

Preferably walls of the container perpendicular to said opposed walls comprise further formations engageable with first and second formations, the further formations being at positions at which a first or second formation of an adjacent container will be located when the containers are pallet stacked as defined below. The first and second formations are preferably located on long walls of the container.

The formations may comprise projections and/or recesses. They may comprise ribs which define recesses therebetween. The container preferably has a rim around the top of the walls, the formations being formed around the rim. The container is preferably stackable and/or nestable with like containers, wherein containers of a pile of containers so formed can engage a corresponding container in an adjacent pile. The engagement of the formations is preferably sufficient loose to accommodate some misalignment of adjacent containers.

An embodiment of the present invention will now be described in more detail, by way of example only, and with reference to the accompanying drawings, in which.

In order to fully appreciate the nature of the present invention, it is helpful first to describe how containers are customarily placed on pallets, for instance, during delivery to retail premises. A conventional container size for retail delivery is 600 mm×400 mm. A conventional pallet size is 1 m×1.2 m. Consequently, five containers (or piles of containers) can be placed on a single pallet by arranging the in the manner shown in FIG. 1. Three containers (marked A) are arranged with long sides parallel. Across their ends, two containers (marked B) are arranged with their short sides parallel to the long sides of the containers A. This forms a rectangle of containers of the same size as the pallet. The containers can be secured to the pallet by straps, bands etc. The term "pallet-stacked" is used in this specification to indicate the arrangement illustrated in FIG. 1. The term "pile" is used herein to encompass stacking and nesting, in view of the common usage of containers which can be arranged to selectively stack or nest.

Figure 2:
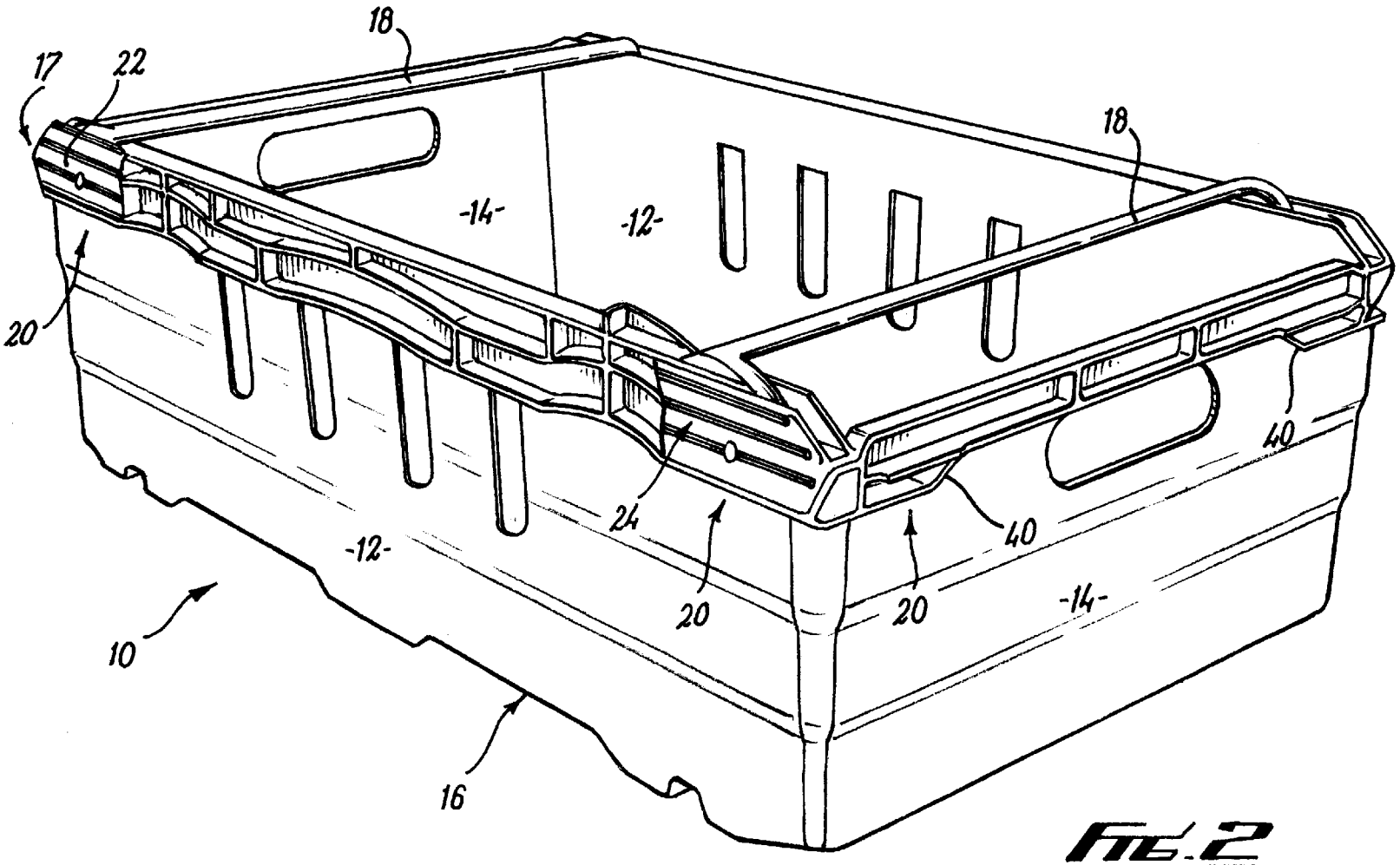
FIG. 2 is a general perspective view on an enlarged scale of a container according to the present invention.

Turning to FIG. 2, the container 10 is open-topped (but may be lidded). It is of generally rectangular shape in plan, having long sides 12 and short sides 14. The illustrated container has a plan size of 600 mm×400 mm. The walls 12, 14 are upstanding around the periphery of the container, from a base 16. Stacking bars 18 are provided to allow a pile to be formed by stacking like containers, but may be retractable to allow a pile of nested containers to be formed.

The outer surfaces of the walls 12, 14 are provided, at locations indicated by the numeral 20, with formations which in may engage formations on an adjacent like container to limit relative vertical movement of the containers, as will be described. The formations at 20 are arranged to provide for engagement when adjacent containers are arranged long side to long side (as the containers A in FIG. 1) or short side to short side (the containers B in FIG. 1) or long side to short side (each container B alongside two containers A in FIG. 1).

Figure 3:
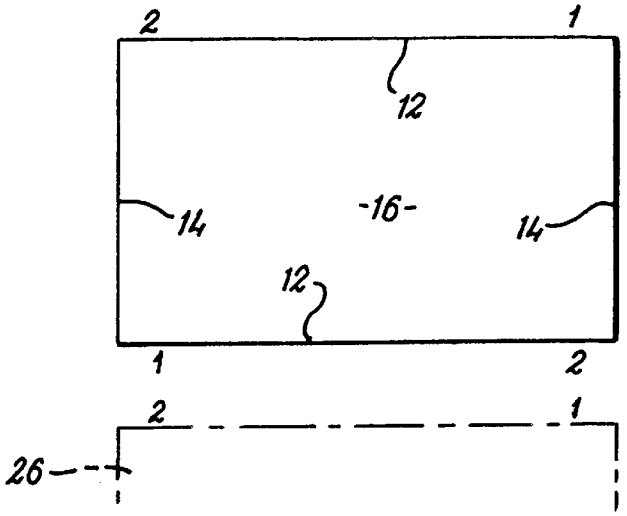
FIG. 3 is a schematic plan view of the container of FIG. 2.
Figure 4:
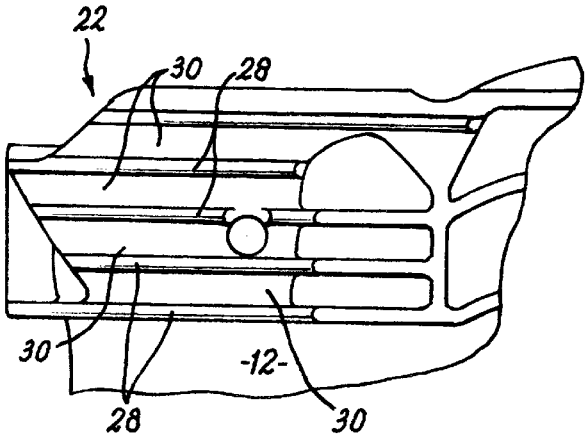
FIGS. 4 and 5 are large partial enlarged elevations of the container of FIG. 2, showing engaging formations.
Figure 5:
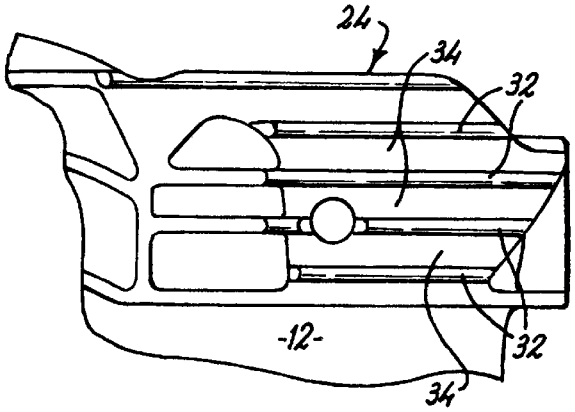

The formations at 20 and their locations are illustrated in more detail in FIGS. 3 to 5. First formations illustrated in FIG. 4 are formed at two corners 1 in FIG. 3, whereas second formations (FIG. 5) are provided at locations 2 in FIG. 3. It will be observed that the locations 1 are at diagonally opposite positions along opposed long walls of the container, and the positions 2 are each opposite one of the positions 1. In consequence, if two like containers are brought together to have long walls adjacent, each location 1 will be alongside a location 2 on the adjacent container as can be seen from the second container indicated in FIG. 3 by broken lines 26.

The first and second formations are complementary in form. This can be seen from FIGS. 4 and 5. The first formations 22 comprise a series of generally horizontal ribs 28 which define recesses 30 between them. Other arrangements of projections and/or recesses could be used. The second formations 24 also comprise ribs (32 in FIG. 3) and recesses (34 in FIG. 5), but as can be seen from comparison of FIGS. 4 and 3, the ribs 32 are at the height of the recesses 30, while the ribs 28 are at the height of the recesses 34. Consequently, the first and second formations 22, 24 may mate when brought together, by ribs 28, 32 entering recesses 30, 34.

Figure 7:
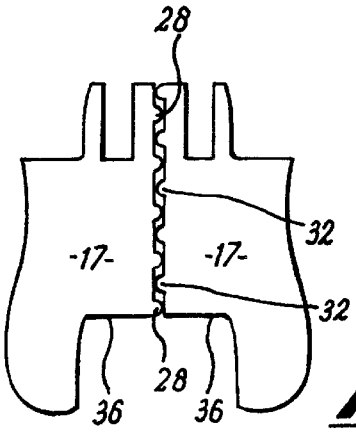
FIGS. 7, 8 and 9 are enlarged partial sections through two adjacent containers, showing engagement of formations on long sides of the container (FIG. 7), between long and short sides (FIG. 8) and between short sides (FIG. 9)

This mating is illustrated in FIG. 7. It is important to note that the ribs are a loose fit in the recesses so that some limited relative movement between the containers is possible before ribs on one container abut ribs on the other. This allows the engagement of the ribs to prevent excessive relative vertical movement of the adjacent containers, but accommodates any minor misalignment which might arise from manufacturing tolerances, unevenness of a pallet on which containers are stacked, or distortions caused by containers containing different weights of goods.

Figure 8:
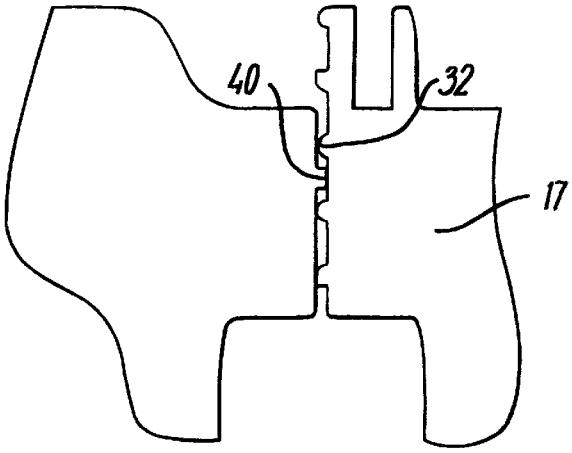
Figure 9:
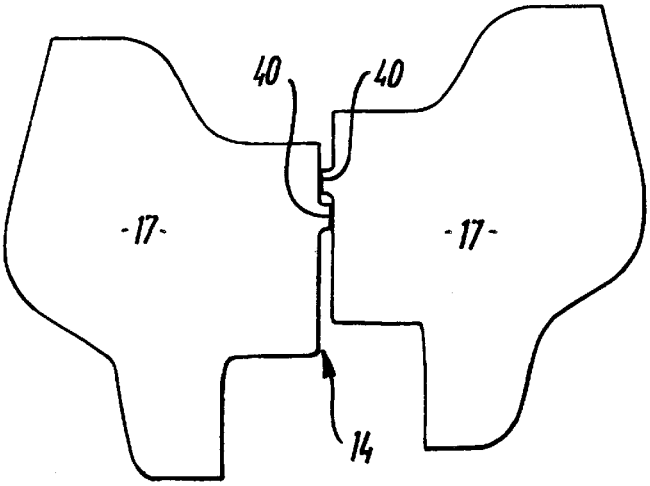
Figure 10:
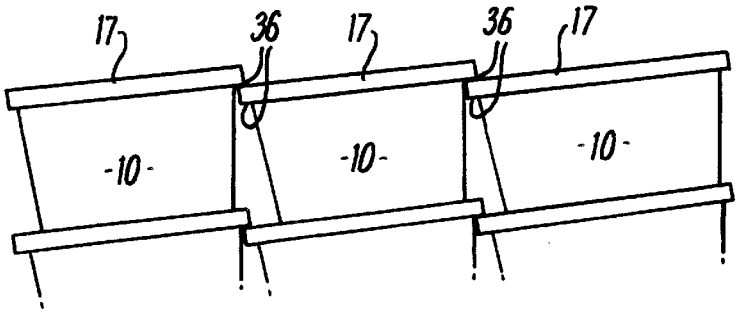
FIG. 10 is a schematic elevation of a plurality of adjacent piles of containers.

In particular, the engagement of the ribs prevents the rim 17 of one container mooring up sufficiently relative to the rim 17 of the adjacent container for one rim to catch under the other rim, against the surface 36. This could cause one pile of containers to topple and lock against an adjacent pile in a toppled condition, as illustrated schematically in FIG. 10 from which it can be seen that one rim 17 is locked under the rim of an adjacent container. This could lead to Instability of pallet stacked containers, or cause damage to their contents. When containers are pallet-stacked, long sides of containers will come along short sides, and short sides will come together, as has been described. Provision to limit relative vertical movement of containers is provided at these locations in a manner to be described with particular reference to FIGS. 6 and 8.

Figure 6:
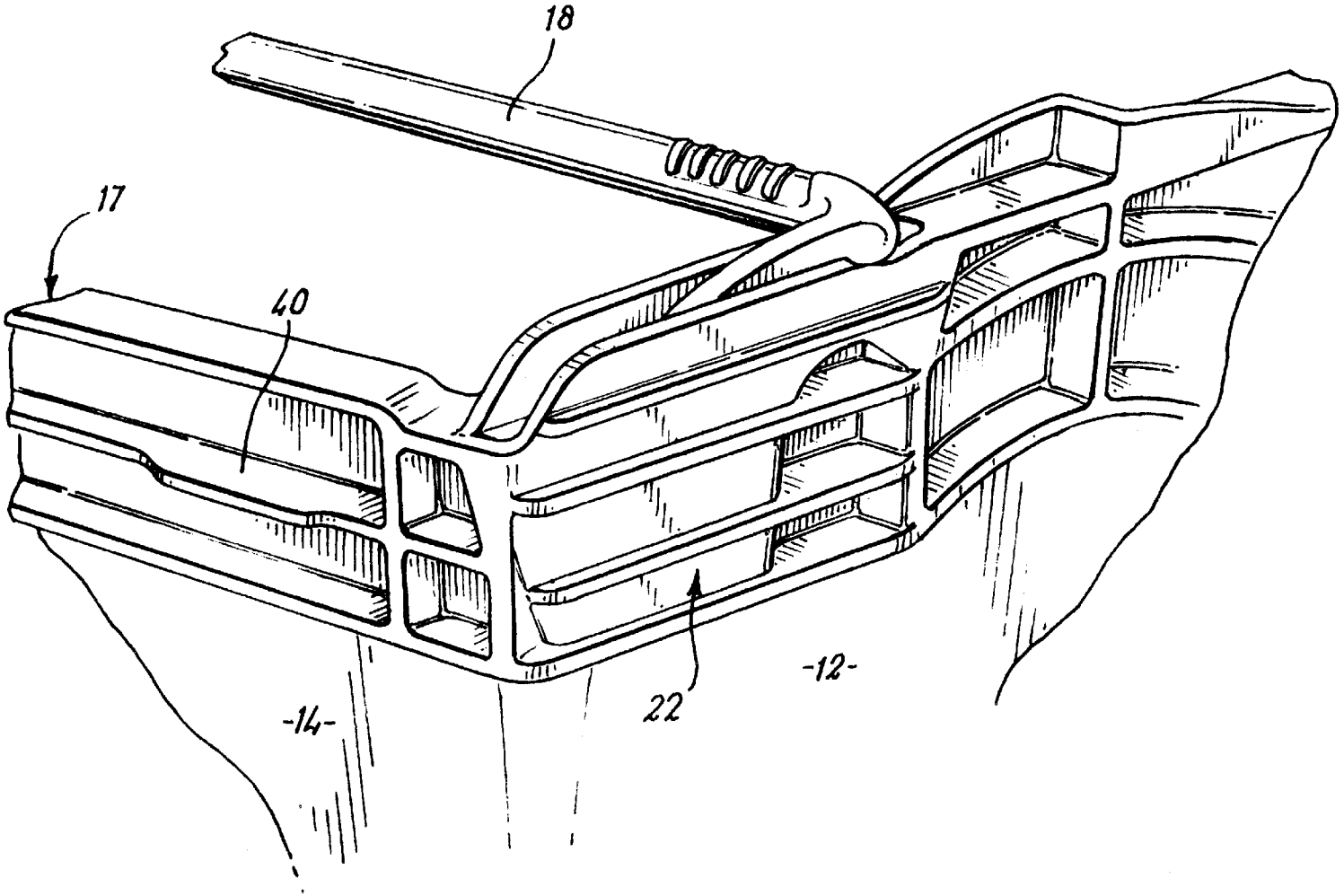
FIG. 6 is a partial perspective view at one corner of the container of FIG. 2, on an enlarged scale, showing an engaging formation on the short side.

FIG. 6 shows a further formation 40 which is a short horizontal flange projecting from the short side near the top of the short side. Another formation 40 is formed at the other end of the short side in an arrangement which is a mirror image of that shown in FIG. 6. The other short side of the container is substantially identical with that shown. In consequence, four formations 40 exist, one adjacent each of the four corners of the container. These four formations 40 are all at the same height above the container base.

The formations 40 will engage with first and second formations 22,24 by sitting in the recesses 30,34. This may require slight relative vertical movement of the containers to allow the formation 40 into the recess 30,34 but this movement is likely to be slight in comparison with distortion occurring in filled containers. Further relative vertical movement is limited by the engagement of the formations 40 and the recesses 30,34.

When containers (such as containers B) are arranged short side to short side, the various formations 40 will come together. These are not complementary but again, slight relative vertical movement will allow one formation 40 to slip over or under the corresponding formation on the other container so that the two formations 40 thereafter engage to limit relative vertical movement between the containers.

Figure 1:
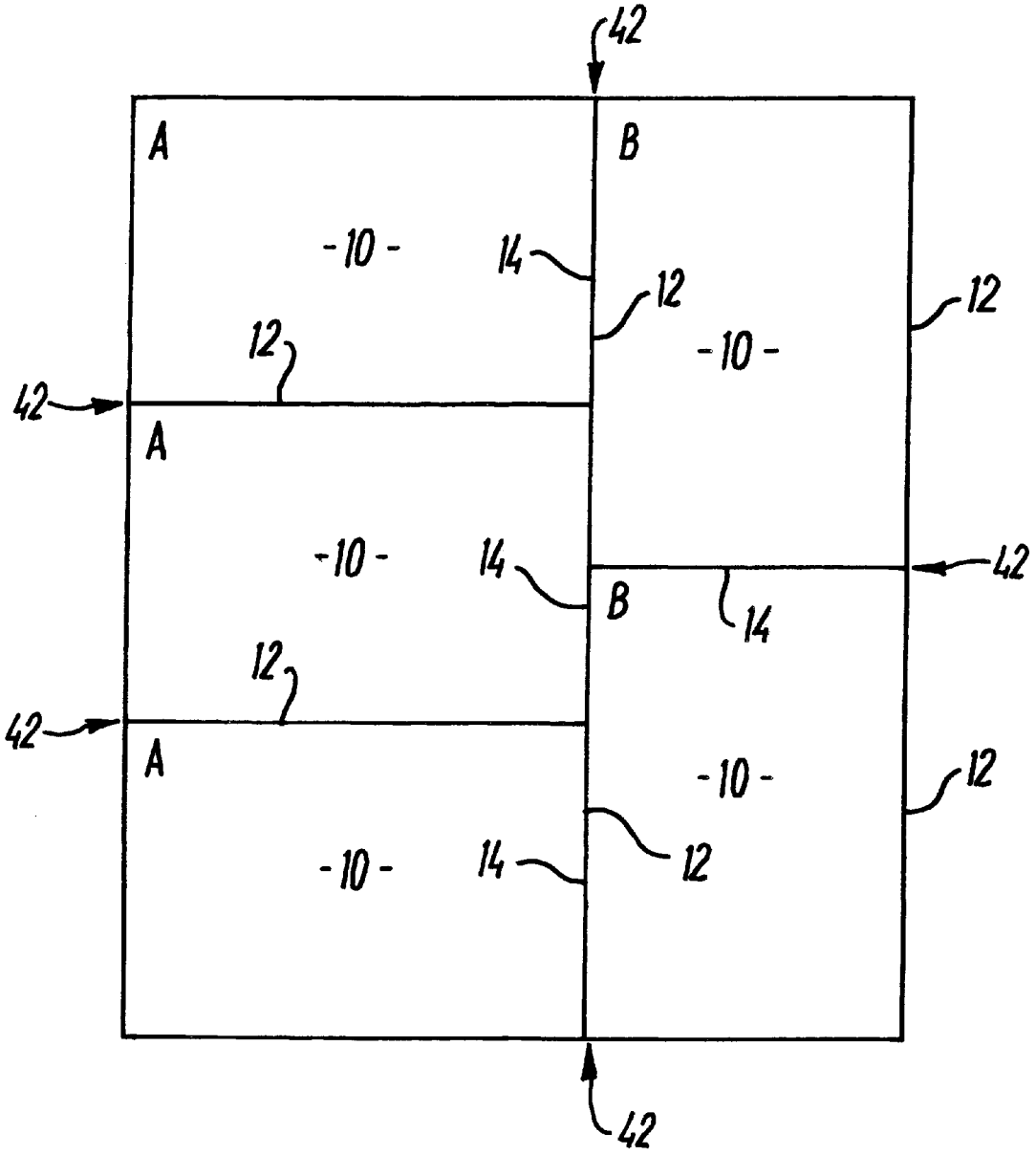
FIG. 1 is a schematic plan view of five container stacks on a pallet.

In consequence of the various types of engagement described above, relative vertical movement between adjacent containers is limited at various positions around the pallet-stacked layer of containers, particularly at the positions 42 indicated in FIG. 1. This, together with conventional straps used to band a stack of containers to a pallet, results in increased security for the stack. Engagement between adjacent containers at positions within the layer, i.e. away from the outer edges of the layer, may be somewhat less secure but is less significant in securing the stack.

It is envisaged that formations of the type described can be readily described can be readily incorporated into stackable and/or nestable containers for a variety of uses. These containers may be manufactured, for instance, by injection moulding or other process, from a synthetic plastics material. Whereas the formations described above have all been based around ribs and the recesses between ribs, very many other forms of inter-engaging formations could be devised, including other arrangements of projections and recesses, other forms of complementary surface, or formations which engage by other means, such as enhanced friction.

While the embodiment has been described particularly in relation to delivery containers for retail use and of a particular size, for pallet stacking on conventional pallet sizes, it will be readily understood that the invention can be applied to many different shapes, sizes and styles of containers for a wide variety of purposes.

Many variations and modifications can be made to the apparatus described above, without departing from the scope of the present invention.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A stacking and nesting container of generally rectangular shape in plan, the container having upstanding walls around its periphery and an overhanging rim around the top of the walls, the rim remaining exposed when the container is nested, there being formations on the outer face of the rim for engagement with formations on the rim of all adjacent like container when the containers are side by side, the formations serving to prevent the rim of one container moving up sufficiently relative to the like container for the rim of the like container to catch under the rim of the said one container.

2. A container according to claim 1, wherein the formations include first formations and further include second formations which have an arrangement complementary to the arrangement of the first formations, whereby a first formation may engage a second formation on an adjacent like container to limit relative vertical movement as aforesaid.

3. A container according to claim 2, wherein the first formations comprise a projection or recess at a first height on the container, and the second formations comprise a recess or projection at a different height, whereby the first formation may engage with the second formation upon relative vertical movement, to limit that movement.

4. A container according to claim 2, wherein the first formations are located at diagonally opposite positions along opposed walls of the container, second formations being located at positions opposite the first formations, whereby first and second formations will come together when one of the said opposed walls is brought adjacent to one of the corresponding opposed walls of a like container.

5. A container according to claim 4, wherein walls of the container perpendicular to said opposed walls comprise further formations engageable with first and second formations, the further formations being at positions at which a first or second formation of an adjacent container will be located when the containers are pallet stacked.

6. A container according to claim 2, wherein the first and second formations are located on long walls of the container.

7. A container according to claim 1, wherein the or at least some of the formations comprise projections which define recesses therebetween.

* * * * *